US006027330A

United States Patent [19]

Lifshits

[11] Patent Number: 6,027,330

[45] Date of Patent: Feb. 22, 2000

[54] LOW $NO_X$ FUEL GAS BURNER

[75] Inventor: Vladimir Lifshits, Redwood City, Calif.

[73] Assignee: Coen Company, Inc., Burlingame, Calif.

[21] Appl. No.: 08/978,704

[22] Filed: Nov. 26, 1997

Related U.S. Application Data

[60] Provisional application No. 60/032,532, Dec. 6, 1996.

[51] Int. Cl.[7] ..... F23C 5/00; F23L 1/00; F23B 5/02; B05B 7/04

[52] U.S. Cl. ..... 431/8; 431/2; 431/115; 431/183; 431/354; 110/204; 239/433

[58] Field of Search ..... 431/8, 181, 115, 431/183, 5, 185, 116, 187, 278, 186, 9, 176, 189, 284, 285, 354, 352, 2; 239/558, 568, 399, 403, 592, 601, 433, 434.5; 110/204, 345; 60/737

[56] References Cited

U.S. PATENT DOCUMENTS

| | | | |
|---|---|---|---|
| 1,124,579 | 1/1915 | Ambursen | 239/403 |
| 2,636,554 | 4/1953 | Young | 431/284 |
| 2,822,864 | 2/1958 | Black | 431/284 |
| 2,889,871 | 6/1959 | Voorheis | 431/9 |
| 3,032,097 | 5/1962 | Marshall | 431/9 |
| 3,179,152 | 4/1965 | Musat et al. | 431/176 |
| 4,643,670 | 2/1987 | Edwards et al. | 431/171 |
| 5,351,477 | 10/1994 | Joshi et al. | 239/403 |
| 5,407,347 | 4/1995 | Bortz | 431/354 |
| 5,441,403 | 8/1995 | Tanaka et al. | 431/284 |

*Primary Examiner*—Ira S. Lazarus
*Assistant Examiner*—David Lee
*Attorney, Agent, or Firm*—Townsend and Townsend and Crew

[57] ABSTRACT

An industrial fuel gas burner fired with a mixture of combustion air having up to about 45% flue gas which flows in a downstream direction along an annular combustion air conduit disposed about an axially movable core of the burner that terminates in an end cone that faces the combustion chamber of the furnace. Within the conduit and upstream of a discharge end thereof is a fuel gas discharge header formed by concentric, radially inner and outer tubular ring-shaped fuel gas headers which are concentrically disposed about an axis of the burner and in fluid communication with a source of pressurized fuel gas. The headers have a multiplicity of fuel gas discharge orifices which form three-dimensionally oriented gas streams directed into the combustion air-flue gas flow in the annular conduit. The orifices have a diameter of at least about 0.1 inch. The fuel gas has a pressure so that the fuel gas streams have sufficient energy to flow portions of the gas to a vicinity of the annular conduit walls to intimately mix the fuel gas with the combustion air and form a substantially uniform combustion air-flue gas-fuel gas mixture at a discharge end of the annular conduit. The end cone periphery mounts a number of blades that create enhanced, non-repetitively irregular turbulence in the flow discharged from the conduit, which causes irregular turbulence along the boundary between the flow and combustion gas which recirculate in the wake of the cone. The core of the burner including the blades can slide along a guide so that the discharge area between the throat and the cone can be varied with the firing rate, and the blades can be moved away from the conduit when the burner operates at full load.

50 Claims, 4 Drawing Sheets

LOW $NO_X$ FUEL GAS BURNER

This application claims the benefit of U.S. Provisional Application No. 60/032,532 filed Dec. 6, 1996.

BACKGROUND OF THE INVENTION

The present invention relates to fuel gas burners which have very low $NO_x$ emissions and in particular to such burners which operate with flue gas recirculated into the combustion air for the burner.

$NO_x$ is formed during the combustion of fuels, is discharged as part of the combustion gas, and constitutes a major atmospheric pollutant. Areas suffering high levels of air pollution, such as population centers in California, now have stringent pollution limits. For industrial burners, such as burners used in thermal power plants, $NO_x$ discharge limits can be as low as 9 ppm. Such low $NO_x$ levels in the flue gases are difficult to reach and require careful burner designs.

Industrial burners generate $NO_x$ in several ways. For example, industrial gas-fired burners generate $NO_x$ from oxidation of atmospheric nitrogen.

One formation mechanism, known as thermal $NO_x$, generates $NO_x$ at a rate exponentially related to the peak temperature and proportional to the residence time of moles of gas at such temperature inside the flame. The production of thermal $NO_x$ can be effectively reduced by diluting combustion air with mostly inert gaseous products of combustion in a process known as flue gas recirculation (FGR). In some burners that generate premixed, or premixed like combustion, the generation of thermal $NO_x$ can be reduced, in a manner similar to FGR, by increasing the relative amount of combustion air.

Another mechanism of $NO_x$ formation, known as "prompt $NO_x$", generates $NO_x$ during the oxidation of molecules of fuel almost instantly as compared to the formation of thermal $NO_x$. The production of prompt $NO_x$ is a strong function of local stoichiometric conditions at the moment of fuel oxidation. Pockets of fuel rich combustion are known to generate most of the prompt $NO_x$, while less than 2 ppm of prompt $NO_x$ is formed when the local stoichiometric excess air is more than 10–20%.

Thus a combustion device in which the fuel is uniformly mixed with air in an amount slightly above stoichiometric and with a substantial amount of FGR generates very low $NO_x$ emissions because both thermal and prompt $NO_x$ are greatly reduced. Experiments show that 9 ppm $NO_x$ emissions with ambient combustion air in an amount 15% above stoichiometric requires about 30% FGR. With the FGR levels of 35–40%, $NO_x$ emissions can be reduced to below 5 ppm.

There are, however, several obstacles to making such a device suitable for a typical industrial application. The first is a reduced flammability of a mixture with such a large amount of FGR and the ensuing difficulty of stabilizing the flame. The second is the proneness of premixed flames to generate destructive pulsations in the combustion volume. The third is reduced turn-down capabilities. For a burner with a conventional nozzle, a turn-down ratio of 10:1 is typically easily achieved. Burners designed for premixed-type combustion, however, generally have a turn-down ratio of not more than about 5:1. Further, with premixed-type combustion burners it is difficult to achieve a uniformly mixed flow of air and fuel prior to fuel ignition without creating a significant volume of a potentially explosive mixture.

One of the known devices which achieves operation with $NO_x$ emissions below 9 ppm uses a very large number, e.g. 1000–1500, of spaced-apart fuel gas discharge openings—orifices. These openings are formed in numerous hollow vanes that traverse the entire flow of combustion air mixed with FGR, thus making the burner very costly.

Since there are so many fuel gas discharge orifices, their diameters must be very small, say on the order of about a few hundredths of an inch.

Such small orifices are easily plugged by even very small particles which may be present in the fuel gas. To prevent the clogging of the orifices, which in turn would upset the relatively even distribution of fuel gas injected into the air stream, the fuel gas requires filtering before it is introduced into the burner. In addition, to prevent corrosion of fuel gas conduits and particle shedding into the stream of fuel, more expensive materials, like stainless steel, must usually be selected for the fuel-carrying components of the burner, which further increases burner costs.

Although burners of the type described in the preceding paragraph can reach $NO_x$ emissions below 9 ppm, they tend to become unstable when operating at partial capacity. As a result, the margins of the operating parameters, within the stability limits of the burner, become more narrow at reduced loads. This limits the practical turn-down ratio for such burners to typically 4:1, even if coupled with the most accurate controls.

Thus, there presently is a need for very low $NO_x$ emitting burners which are economical to build and which are capable of reliably operating within a wide turn-down ratio.

SUMMARY OF THE INVENTION

The present invention provides a gas burner which emits as little or less $NO_x$ than the lowest $NO_x$ emitting burners presently available on the market, and which is economical to build and operate over a wide turn-down ratio.

Generally speaking, such a burner has an annulus formed concentrically about an axis of the burner and through which a mixture of combustion air and flue gas flows in a downstream direction towards a discharge opening. A typical width of the annular passage is 0.25 of the burner throat diameter. Preferably two ring-shaped fuel gas headers are concentrically arranged inside the annular conduit in a common plane, each conduit including a multiplicity of fuel gas discharge orifices. All orifices are arranged so that fuel gas streams or jets discharged from them are "three-dimensionally" discharged relative to the combustion air and flue gas flowing through the annular conduit; that is, so that each gas stream has a radial component, an axial downstream component, and a tangential component relative to the burner axis. The orifices in each header are typically arranged in two circles so that the radial component of gas jets discharged from the outer circle is in a radially outward direction, while the orifices of the inner circles give the discharged gas jets a radially inwardly directed component.

The burner includes a cylindrical center which is isolated from the flow and ends in an end cone that deflects the annular flow away from the burner center line.

Each fuel gas stream is given sufficient kinetic energy to penetrate into the flow of air and flue gas and rapidly mix with the flow so that, by the time the mixture reaches the point of its ignition after passing the end cone, the fuel gas is uniformly distributed across the flow of air and flue gas.

This is achieved by providing each orifice with a diameter of at least about 0.1 inch and discharging the gas from the orifices with sufficient speed, during full load operation typically in the vicinity of sonic speed (about 1300 ft/sec for natural gas). For a burner having a radial duct width of about 6 inches, this is attained, depending on the design of the orifice and the operating conditions, at fuel gas pressures of about 10–20 psig when the combustion air flows through the annular duct at a velocity in the range of between about 100 and 150 feet per second. The orifices are spaced from the discharge end of the duct by about three times the width of the annular passage for the mixture of air, flue gas and fuel gas.

The tangential component of the gas streams causes a spiral motion in the flow through the annular conduit which enhances recirculation flow in the wake of the center cone. This recirculation zone helps provide reliable ignition of the mixture even with the relatively high amounts of FGR required to reduce $NO_x$ emissions to a few ppm when firing natural gas.

Another aspect of the invention positions a number of blades along the periphery of the center cone. The blades create enhanced turbulence along the boundary between the recirculation zone of the burner and the annular flow where the ignition of the mixture occurs. This enhanced turbulence helps prevent flame pulsations and combustion instability.

At lowered firing rates, however, the discharge velocity of the flow reduces and so does the turbulence energy in the ignition region. To maintain the turbulence necessary to avoid flame pulsation, the cone at the burner center can be retracted into the burner throat. This reduces the cross-sectional discharge area for the flow at the cone end and in turn makes it possible to operate the burner with a turn-down ratio of as much as 12:1 and more, which is a substantially higher turn-down ratio than is typically required for the industrial burners.

To further enhance the stability of the combustion during turn-down operation, the present invention provides additional fuel gas injectors in the nature of core nozzles which protrude through the center cone of the burner. These injectors bring a relatively small amount of the overall fuel flow to the burner. During turn-down operations, it is typical that the amount of excess air increases because low air flow rates are difficult to control. The extra fuel injected at the core helps to maintain close to stoichiometric burning conditions in the recirculation zone in the wake of the cone during turn-down operations. At higher firing rates the effect of the core nozzles on the combustion is usually negligible.

A further feature of the present invention arranges secondary gas injectors around the burner. Although these injectors do not enhance the stability of the combustion, they can allow one to achieve the required $NO_x$ emission levels with lower FGR rates.

DESCRIPTION OF THE PREFERRED EMBODIMENTS

Figure 1:
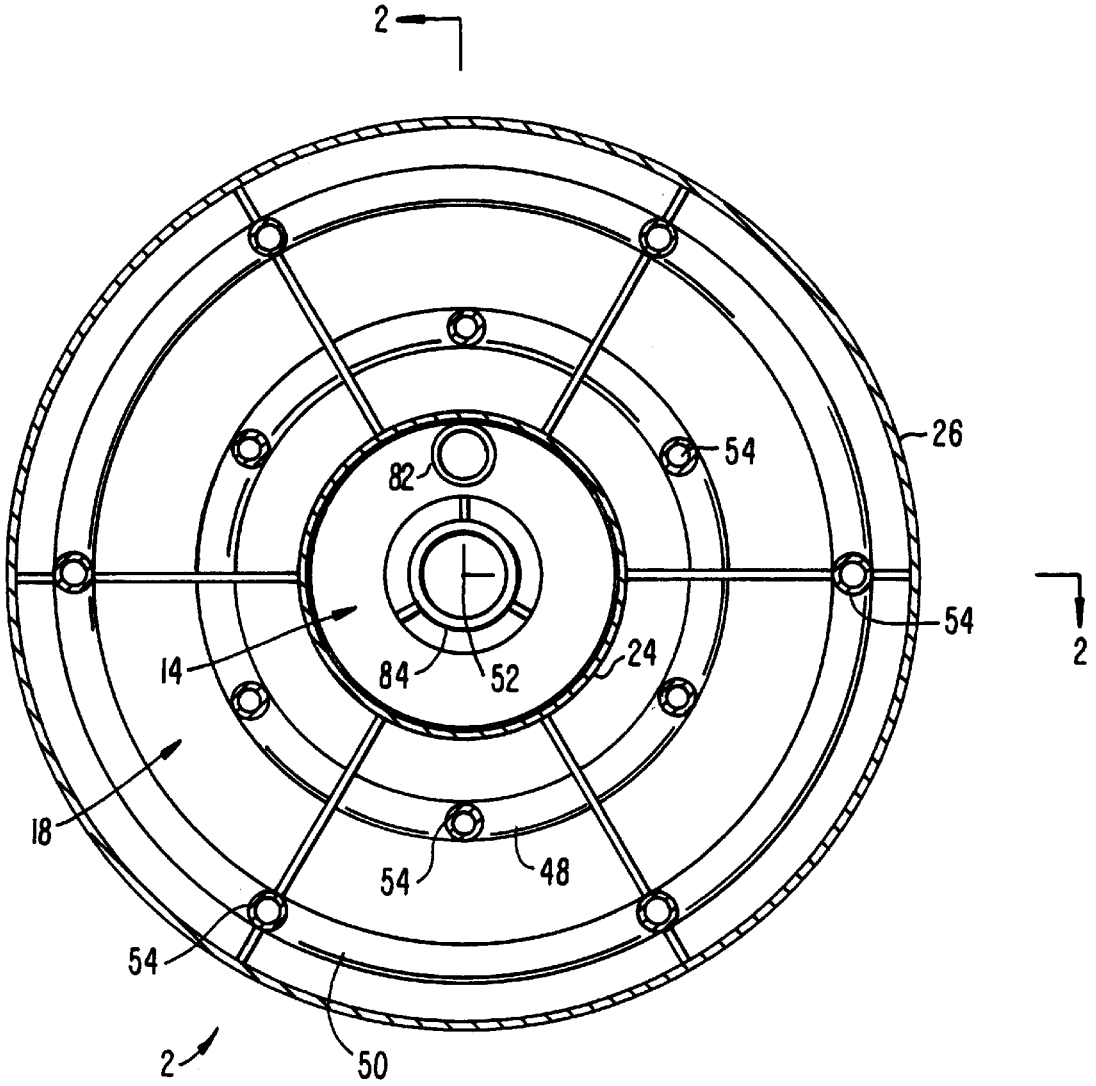
FIG. 1 is a front elevational view of a low $NO_x$ burner constructed in accordance with the present invention.
Figure 3:
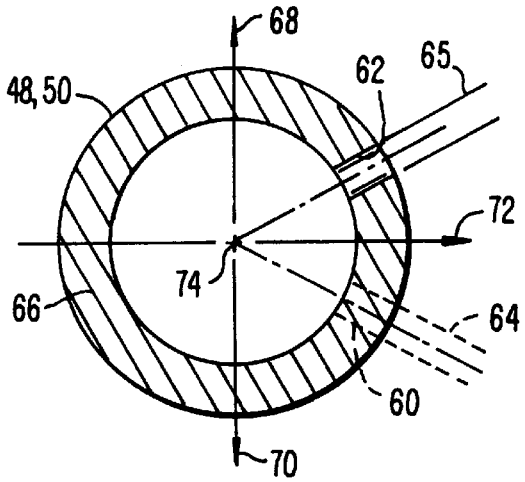
FIG. 3 is an enlarged, cross-sectional view through a fuel gas discharge header constructed in accordance with the present invention.
Figure 2:
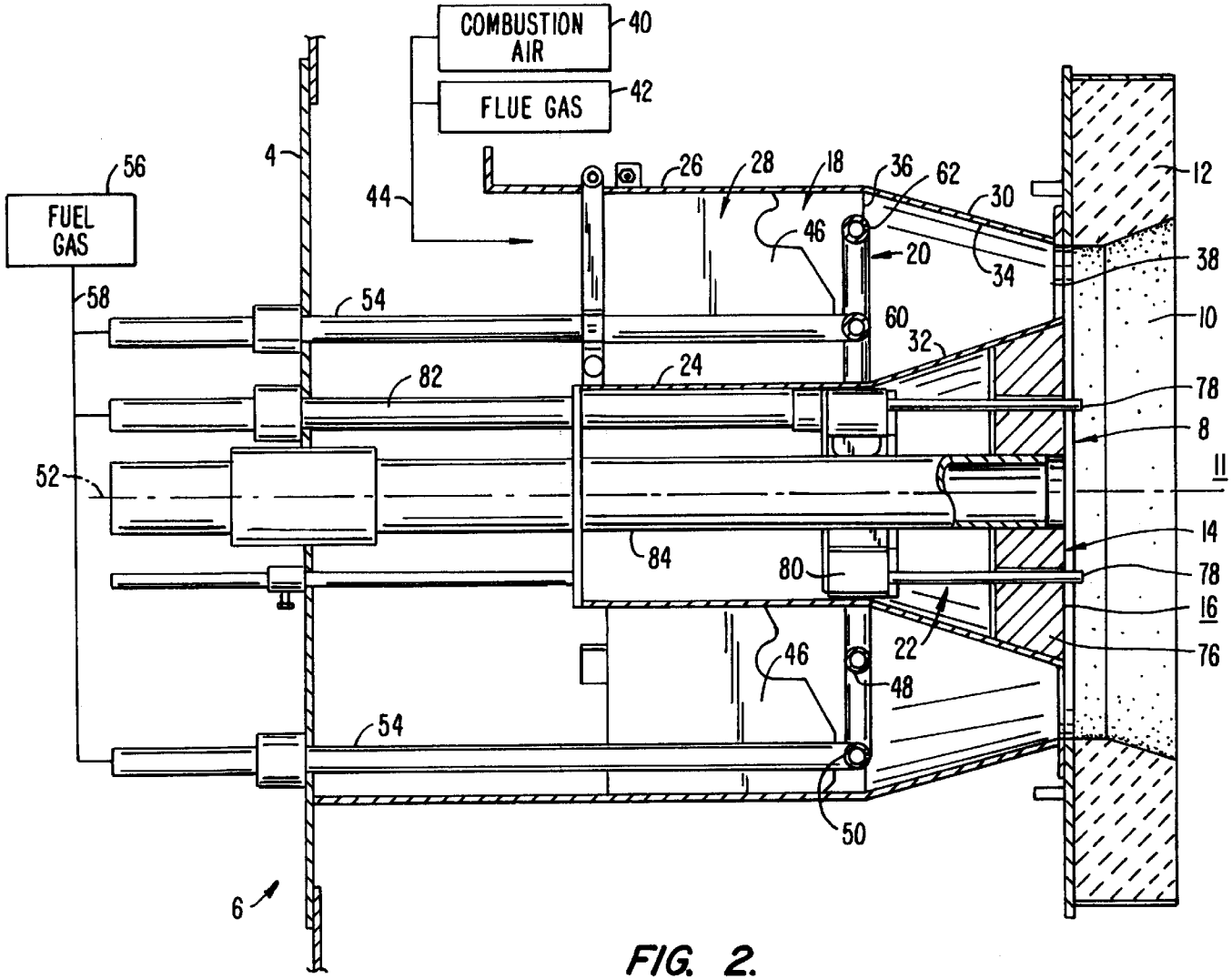
FIG. 2 is a cross-sectional view of the burner shown in FIG. 1 and is taken along line 2—2 of FIG. 1.

Referring to FIGS. 1–3, a burner 2 constructed in accordance with one embodiment of the present invention is carried on a burner front plate 4 of a furnace 6 and has a downstream end 8 facing a burner throat 10 (defined by a refractory throat 12 of the burner) and a combustion chamber 11 of the furnace. The smallest inside diameter 12A of the burner throat defines the nominal diameter of the burner. The burner broadly comprises a core section including an end cone 14 ending at a downstream cone end 16, an annular conduit 18 which surrounds the core, a primary fuel gas discharge system 20 disposed within the annular conduit, and a secondary fuel gas discharge arrangement 22 formed in the core. The largest diameter 14A of the end cone will typically be in the range of between about 0.6 to 0.8 of the nominal burner diameter.

The annular conduit 18 is formed by radially inner and outer walls 24, 26 and has a straight upstream section 28 of substantially constant radial width and a downstream section 30 defined by inner and outer walls 32, 34 which converge in a downstream direction from a point (plane) 36 where the two sections are joined to an annular discharge opening 38 of the conduit which communicates with burner throat 10 and combustion chamber 11. Air from a source of combustion air 40 and flue gas from a discharge or exhaust flue 42 are mixed in the desired proportions, e.g. 70%–75% air and 25%–30% flue gas, and flow through a suitable conduit 44, which may include appropriate shut-off and/or proportional mixing valves (not shown), to the upstream end of the annular combustion air conduit 18. The air and gas flow axially along the annular conduit in a downstream direction towards discharge opening 38. Radially oriented vanes 46 may be provided in the upstream section 28 of the conduit for directionalizing the flow into a substantially axial flow at the downstream ends of the vanes.

The primary fuel gas discharge system 20 of the present invention is defined by a plurality (e.g. two) of ring-shaped, radially inner and outer tubular headers 48, 50 which are arranged in a common plane that is vertical to a longitudinal axis 52 of the burner and which is preferably slightly upstream of point 36 where the upstream and downstream annular sections meet. Each header is made, for example, from ¾ inch steel pipe and is attached to a plurality of, for example, six elongated gas supply tubes 54 which are mounted to burner front plate 4. The gas supply tubes are in fluid communication with the respective headers and with a source of fuel gas 56 and provide the headers with fuel gas of the required pressure. The provision of more than one gas supply tube 54 makes it easier to maintain an even pressure inside the headers. As a result, the gas streams issuing from orifices 60, 62 of the headers are uniform, which helps attain a uniform fuel gas-combustion air-flue gas mixture in the annular conduit. Proper valves (not shown) are provided at the fuel gas source or in a feed line 58 communicating the source with the gas supply tubes 54.

Each tubular header 48, 50 has a multiplicity of fuel gas discharge orifices 60, 62, respectively, which "three-dimensionally" discharge fuel gas streams 64, 65 (schematically illustrated in FIG. 3) into the combustion air-flue gas flowing through duct 18. In a preferred embodiment of the invention, the orifices 60, 62 are holes drilled through header walls 66. The axes of the holes are directionalized so that the center lines of the orifices have a radial component, either radially outwardly oriented (relative to radial direction 68 for orifices 62) or radially inwardly oriented (relative to radial direction 70 for orifices 60 as illustrated in phantom lines in FIG. 3), an axial directional component in downstream direction 72, and a tangential directional component relative to a circle concentric with burner axis 52. The latter direction is not illustrated in FIG. 3 but is obtained by giving the axes of the orifice hole a direction which additionally generally extends in the direction of but is not parallel to the ring-shaped center line 74 of the header.

When burner 2 is installed in a furnace 6 it will also be provided with a pilot (not shown) to ignite the fuel gas, and the burner may have viewing ports, flame scanners and the like, as is conventional in the art but not illustrated in the drawings or further described herein.

The number of orifices formed in the headers is selected to effect a distribution of the fuel gas streams into the annular conduit which results in a uniform combustion air-flue gas-fuel gas mixture at discharge opening 38 of the burner. In one embodiment of the invention, in which the outer wall 26 of upstream conduit section 28 has a diameter of about 24 inches and the annular conduit section has a radial width of about 8 inches, the radially inner and outer headers have diameters of about 14 and 20 inches, respectively, and are provided with 72 and 100, equally spaced-apart fuel gas discharge orifices 60, 62, respectively. On this burner, the headers were provided with a total of 172 discharge orifices with an orifice diameter of 0.1 inch and an average linear spacing between the orifices of about 0.75 inch. For larger burner sizes correspondingly more fuel gas discharge orifices and/or larger orifice diameters will be provided. It is presently contemplated that an overall orifice number in the range of between about 70 and 280 for a burner with two concentric headers is sufficient for burners having ratings from as little as 5 million BTU to as much as 200 million BTU/hr and more.

With a combustion air-flue gas velocity in the annular conduit 18 at rated capacity of between about 60 and 80 feet/sec, an orifice diameter of 0.1 inch, and natural gas of a pressure of between about 10–20 psig as fuel gas, the resulting fuel gas streams three-dimensionally discharged from the orifices into the combustion air stream have sufficient energy to propel fuel gas from the orifices to the vicinity of converging downstream duct section walls 30, 32, resulting in a substantially uniform combustion air-flue gas-fuel gas mixture at the conduit discharge opening 30. This burner was operated with as much as 50% of flue gas in the combustion air-flue gas mixture flowing through the annular conduit. A stable flame was maintained in the burner throat and the combustion chamber and $NO_x$ emissions as low as 2 ppm were measured.

As was earlier mentioned, the provision of a secondary fuel gas discharge arrangement at the center cone 14 of the burner can facilitate stabilizing the flame, particularly when operating in a turn-down mode. For this purpose, a disk-shaped end piece 76, which can be made from refractory material, metal or the like, is mounted in the space surrounded by tapered conduit wall 32 and is suitably secured thereto. A plurality of, say, six equally spaced-apart gas nozzles 78 extend through the core disk and communicate with a secondary, ring-shaped fuel gas header 80 disposed inside the burner core. A gas supply tube 82 fluidly connects the secondary fuel gas header with fuel gas source 56. A fuel control valve (not shown) is provided at a suitable point along the gas supply tube so that the secondary fuel gas discharge arrangement 22 can be activated and operated independently of the primary discharge system 20 described above. In a presently preferred embodiment of the invention, gas nozzles 78 are constructed so that they discharge gas streams into the burner throat 10 in a direction which is tangential with respect to burner axis 52.

The burner can further be converted for occasionally operating it with fuel oil by extending a central fuel oil guide pipe 84 concentrically with burner axis 52 over the length of the burner. The fuel oil guide pipe is carried by burner front plate 4 and provides a conduit through which a fuel oil supply pipe (not shown) can be inserted in a downstream direction so that a fuel atomizing head (not shown) at the downstream end of such pipe protrudes past the guide pipe and core end face 16 into burner throat 10.

Figure 4:
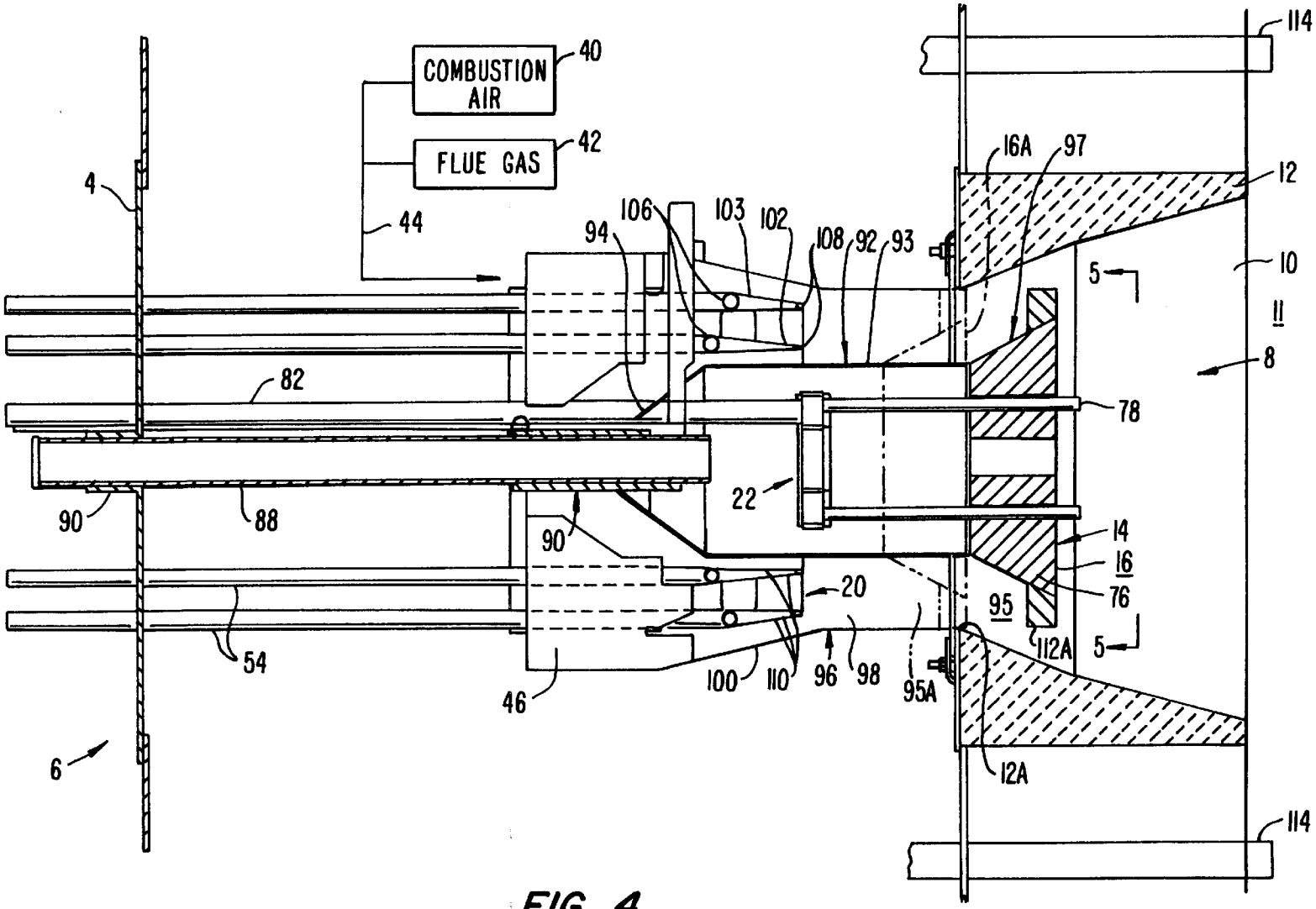
FIG. 4 is a cross-sectional view, in section, similar to FIG. 2 and illustrates other embodiments of the present invention.
Figure 5:
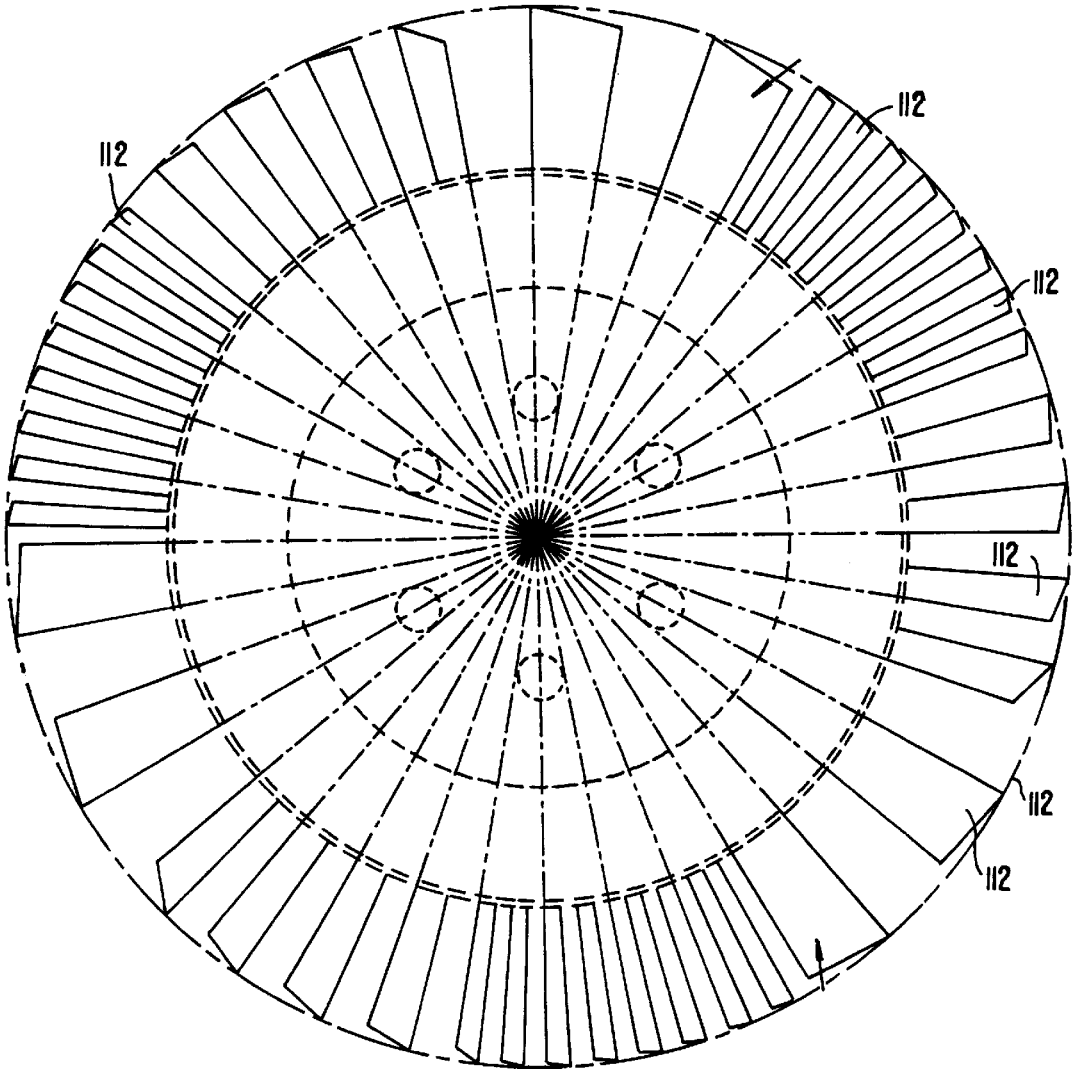
FIG. 5 is a schematic, front elevational view taken on line 5—5 of FIG. 4.

Referring now to FIGS. 4 and 5, in another embodiment of the present invention a tubular core section or core 92, including end cone 14, can be retracted so that end face 16 of the cone can be moved from its fully extended position (for full load operation) shown in FIG. 4 to the left to a retracted position in which the cone face 16A is retracted away from the combustion chamber. This enhances flame stability and prevents flame pulsations during turn-down operation of the burner. A guide tube 88 extends through a bearing 90 from outside burner front plate 4 to the interior thereof. On the interior, the guide tube is suitably supported (not shown). The core 92 includes a frustum upstream end 94. The downstream end of the core is formed by end cone 97. The core is carried by and axially movable along guide tube 88 between the retracted and extended positions. A mechanism (not separately shown) is provided for reciprocating the core.

An outer conduit wall 96 is concentric about the burner axis and spaced radially outwardly of core 92 so that the space between the outer wall and the core defines an annular conduit 98. The outer conduit wall is stationarily mounted to the furnace and includes a converging section 100 between the upstream and downstream ends of the conduit. The converging section is located so that at least its downstream end (that is, the end closest to combustion chamber 11) overlies the cylindrical portion 93 of core 92 at all times irrespective of whether the core is in its extended and retracted position, or anywhere between them.

The cylindrical portion 93 of core 92 is further dimensioned so that, when the core is in its fully extended position (shown in solid lines in FIG. 4), the intersection between the cylindrical portion and the end cone is at about, or slightly downstream of, the end of outer conduit wall 96 to form a flared annular passage 95 between the end cone 97 and the burner throat through which the air/flue gas/fuel gas mixture must flow before it enters the combustion chamber 11. The core can be retracted (to the left as shown in FIG. 4) so that the end face 16A of end cone 97 is at or just downstream of the downstream end of the conduit wall 96, as is illustrated in phantom lines in FIG. 4. When in this position, the gas mixture must flow through an annular passage 95A between the cone 97 and conduit wall 96 which decreases in cross-section.

In use, the combustion air and flue gas mixture is directed through air/flue gas supply line 44 into annular conduit 98 where the opposing surfaces of the core 92 and outer conduit 96 form an annular air/flue gas flow past converging conduit section 100 and passage 95 (or 95A) for discharge into burner throat 10 and hence combustion chamber 11. The primary fuel supply system—headers 20 and 48—, see FIG. 1, is located in the converging section of the annular conduit. Since core 92 is axially movable, the cross-section of the annular conduit downstream of the primary fuel system cannot be as conveniently reduced as in the embodiment shown in FIG. 4.

To prevent an uneven mixing of the fuel with the air/flue gas mixture, fuel headers 102, 104 are aerodynamically shaped. Spacers and the like (not separately shown) support and stationarily mount the headers 102, 104 of the primary fuel system and their gas supply pipes 54 inside annular conduit 98. Each header has a preferably tear-shaped cross-section, as is readily seen in FIG. 4, which defines a relatively larger upstream end 106, that is coupled to a plurality of circumferentially spaced-apart primary fuel supply tubes 54, and a relatively smaller downstream end 108. The earlier discussed fuel discharge orifices (not shown in FIG. 4, shown as 60 and 62 in FIG. 3) extend three-dimensionally in radially inward and outward directions, respectively, as is described above. Straight, converging walls 110 extend between the upstream and downstream ends of the headers and form smooth surfaces over which the air/flue gas mixture flows.

This configuration of the header reduces flow turbulence in the annular conduit that is essential for preventing flame from flashing back when operating at turn-down. By aerodynamically shaping the header, rather than giving it a round cross-section, the flow resistance is also reduced, enabling operation of the burner with relatively lower air pressure. Since the headers are positioned in the converging section 100 of the annular conduit, the available flow cross-section for the gaseous mixture over the length of the header, and downstream thereof (where the fuel gas is injected), can be maintained more nearly constant, which reduces unwanted losses of air pressure.

Since the headers at all times overlie the cylindrical portion 93 of core 92, the configuration of the flow cross-section of the annular conduit in the vicinity of the headers does not change irrespective of whether the core cylinder, and with it end cone 14, are in their retracted or extended positions.

Upstream of fuel headers 102, 104, annular conduit 98 preferably includes air/flue gas directionalizing vanes 46 which are arranged and function as was earlier described.

The core fuel system 22 is disposed inside the hollow core 92 and includes, as above described, fuel gas nozzles 78 which protrude past end cone 14 and emit tangentially oriented secondary fuel gas streams, particularly for use during turn-down operation of the burner. The core fuel discharge system 22 is mounted so that it moves axially with the core cylinder. This requires a mounting of the pipes so that they can move axially with the core through a suitable axial bearing (not separately shown).

As was discussed at the beginning of this application, flame pulsation can be reduced or eliminated and the combustion rendered stable, particularly during turn-down operation of the burner, by increasing velocity and turbulence along the boundary between the recirculation zone of the burner (in the wake of end cone face 16) and the annular flow of the air/flue gas/fuel gas mixture. For this purpose, the present invention places multiple blades 112 of differing sizes and angularity (relative to the mixture flow past flared passage 95) along the periphery of end cone 97, which causes an essentially random; that is, non-repetitive, flow pattern of the mixture discharged from the passage without affecting the even distribution of the fuel gas in the air/flue gas mixture. The non-repetitive flow pattern of the mixture that is about to be ignited helps to avoid synchronized pulsations of the flame when the mixture contains relatively large amounts of flue gas necessary to achieve the above-discussed low $NO_x$ emissions. The arrangement of blades 112 in FIG. 5 is illustrative only to show how circumferential portions of the mixture flow cross-section are non-repetitively directionalized by the blades so that adjoining cross-sectional flow areas differ from each other non-repetitively. The diameter 112A of the periphery of the blades is typically in the range of between about 0.9 and 1.05 the nominal burner diameter.

As mentioned earlier, $NO_x$ emissions can also be reduced, particularly when the burner is operated in its turn-down mode, by positioning secondary fuel gas injectors 114 about the periphery of the burner. As is known, burning of gas delivered by secondary injectors, especially during turn-down operation, generates relatively low $NO_x$ emissions, mostly "Prompt $NO_x$" as the gas jets entrain significant amounts of relatively cold combustion products from the furnace volume. When the secondary gas injectors are used, relatively less fuel gas is injected through primary fuel supply system 20 (FIG. 1), or 102, 103 (FIG. 4). As a result, primary fuel burns with a higher amount of air that allows the use of less FGR to maintain the desired low $NO_x$ emissions. Maintaining minimum amounts of FGR at turn-down operation is especially important due to increased difficulties of accurately controlling FGR at reduced flows.

What is claimed is:

1. A burner assembly producing low $NO_x$ emissions having a longitudinal axis and comprising means forming an annulus about the axis and defining a downstream-facing, annular discharge opening; means for flowing combustion air in a downstream direction through the annulus; a tubular fuel gas header disposed in the annulus, located upstream of the discharge opening, having a tubular wall and including a multiplicity of orifices extending through the tubular wall and being oriented for discharging directionalized fuel gas streams through the orifices into the annulus, each of the gas streams including a radial component, an axial component, and a tangential component relative to a circle concentric with the axis; and energizing means imparting sufficient kinetic energy to the fuel gas streams so that they penetrate combustion air flowing through the annulus and mix with the air into a substantially uniform fuel gas-air mixture for discharge of the mixture from the downstream opening of the annulus.

2. A burner assembly according to claim 1 wherein the energizing means comprises a diameter for each orifice of at least about 0.1 inch.

3. A burner assembly according to claim 2 wherein the energizing means comprises a source of fuel gas pressurized sufficiently so that the fuel gas streams discharged from the orifices penetrate the combustion air flowing through the annulus to a point proximate a radially outermost boundary of the annulus before the mixture reaches the downstream opening.

4. A burner assembly according to claim 1 wherein the orifices define first and second sets of orifices distributed about the annulus, the first set of orifices forming fuel gas streams which have a radially outward directional component and the second set of orifices forming fuel streams which have a radially inward directional component.

5. A burner assembly according to claim 4 wherein the first and second sets of orifices are formed by the header which, in a cross-section parallel to the axis of the burner, has an upstream end which is relatively larger than a downstream end.

6. A burner assembly according to claim 5 wherein the orifices are formed in the downstream end of the header.

7. A burner assembly according to claim 5 wherein the cross-section of the header is generally tear-shaped.

8. A burner assembly according to claim 4 wherein the header comprises first and second, tubular headers disposed in the annulus, and wherein the first and second sets of orifices are formed by the headers.

9. A burner assembly according to claim 8 wherein the headers comprise ring-shaped tubes each having a wall, and wherein the first and second sets of orifices are defined by holes formed by the walls of the headers.

10. A burner assembly according to claim 9 wherein the tubes each have a length, and including a plurality of spaced-apart fuel gas supply pipes for and in fluid communication with each of the tubes for effecting a substantially even fuel gas pressure inside the tubes and over substantially their entire lengths.

11. A burner assembly according to claim 9 wherein the holes formed by the header walls have a diameter of at least about 0.1 inch.

12. A burner assembly according to claim 4 wherein the header comprises a first header and a second header, wherein the first header is located radially outwardly of the second header.

13. A burner assembly according to claim 12 wherein the first and second headers are concentric with respect to the burner axis.

14. A burner assembly according to claim 13 wherein the first and second headers lie in a common plane which is substantially perpendicular to the axis.

15. A burner assembly according to claim 14 wherein the annulus includes a section between the headers and the discharge opening defined by converging surfaces so that a radial width of the annulus at the headers is greater than a radial width of the annulus at the discharge opening.

16. A burner assembly according to claim 4 including a core section which is surrounded by the annulus and extends in a downstream direction of the burner to a plane which is proximate to a plane in which the discharge opening of the annulus is located.

17. A burner assembly according to claim 16 wherein the core section defines an end cone having a downstream-facing end face and a radially inner boundary of a portion of the annulus extending upstream from the annular discharge opening; and including a mechanism for axially moving the core section between extended and retracted positions towards and away from the header.

18. A burner assembly according to claim 17 wherein the core section defines a cylindrical, radially inner boundary of the annulus which is dimensioned so that the first and second sets of orifices overlie the cylindrical section when it is anywhere between its retracted and extended positions.

19. A burner assembly according to claim 18 wherein a portion of the annulus downstream of the first and second sets of orifices has a substantially constant cross-section when the core section is in its extended positions.

20. A burner assembly according to claim 19 wherein the portion of the annulus downstream of the first and second sets of orifices has a cross-section which decreases in a downstream direction when the core section is in its retracted position.

21. A burner assembly according to claim 16 including flow deflectors located proximate the discharge opening of the annulus and operative to impart a non-repetitive, turbulent flow pattern to gas flowing past it.

22. A burner assembly according to claim 16 including a plurality of auxiliary fuel gas discharge openings substantially equally distributed about the axis of the burner and located in a vicinity of the core section for discharging secondary fuel streams from the core section of the burner.

23. A burner assembly according to claim 1 comprising in the range of between about 100 and 250 orifices.

24. A furnace installation generating low $NO_x$ emissions comprising a combustion chamber and a burner assembly having a longitudinal axis, the burner assembly comprising an annular duct concentrically disposed about the axis, the duct having an upstream section and a downstream section, the upstream section including means for receiving a mixture of combustion air and flue gas, and the downstream section terminating in a discharge opening facing into a combustion chamber, the downstream section having a radial width which decreases towards the discharge opening; first and second, radially spaced-apart inner and outer ring-shaped fuel headers disposed concentrically about the axis and upstream of the discharge ends; a multiplicity of first orifices in the radially outer header, each orifice having an orifice axis which is generally radially outwardly directed and includes an axial, downstream directional component and a tangential directional component relative to a circle concentric with the burner axis; a multiplicity of second orifices in the radially inner header, each second orifice having an orifice axis which is generally radially inwardly directed and includes an axial, downstream directional component and a tangential directional component relative to a circle concentric with the burner axis; means in fluid communication with the upstream section of the annular duct for flowing a mixture of combustion air and flue gas through the annular duct in a downstream direction past the fuel headers and through the discharge opening of the downstream section; and means for supplying the headers with pressurized fuel gas having sufficient pressure so that fuel gas streams discharged from the first and second orifices transport fuel gas from the orifices to a vicinity of radially outer and radially inner boundaries, respectively, of the downstream section to form a substantially uniform fuel gas-combustion air-flue gas mixture upstream of the discharge end for discharging the substantially uniform mixture into the combustion chamber so that the fuel gas is combusted in the combustion chamber and forms a relatively low-temperature flame generating low $NO_x$ emissions.

25. An installation according to claim 24 wherein the headers are located proximate a transition between the upstream and downstream sections of the annular duct.

26. An installation according to claim 25 wherein the downstream section of the annular duct is defined by at least one longitudinally tapered wall, and wherein the headers are located at about an axial intersection between the tapered wall and a wall of the upstream section of the duct which is substantially parallel to the burner axis.

27. An installation according to claim 24 wherein the first and second orifices are defined by walls of the outer and inner headers.

28. An installation according to claim 27 wherein the orifices have a diameter of at least about 0.1 inch.

29. A burner assembly comprising an annular conduit disposed about a longitudinal axis of the burner and defined by a core and an outer, tubular wall, the annular conduit including an upstream end, a fuel injection zone downstream thereof, and a fuel mixing zone downstream of the fuel injection zone and terminating in a discharge end of the conduit, a portion of the annular conduit forming the fuel discharge zone converging in a downstream direction; the core including an end cone having a downstream oriented end face and a periphery which defines a radially inner, downstream end portion of the annular conduit; a fuel discharge header including a plurality of orifices for directing a fuel gas generally in the downstream direction and into the converging portion of the fuel discharge zone and towards the mixing zone; means for connecting the header with a source of fuel gas; and a mechanism for axially moving the core relative to the fuel discharge header between extended and retracted positions in which the end face of the cone is relatively remote from and proximate to the fuel discharge header, respectively; whereby unstable combustion and flame pulsation are reduced when the core is in its retracted position and the burner is operated in its turn-down mode.

30. A burner assembly according to claim 29 including a central guide adapted to be secured to the furnace for supporting the core concentrically in the burner and permitting relative axial movements of the core.

31. A burner assembly according to claim 27 wherein a header, in cross-section, is drop-shaped and has a relatively larger upstream end and a relatively smaller downstream end, and wherein the orifices are formed in the downstream end of the header.

32. A burner assembly according to claim 31 wherein a cross-section of the annular conduit decreases over an axial length of the header.

33. A burner assembly according to claim 29 including a multiplicity of blades carried by the core and arranged so that the blades extend over substantially an entire cross-section of the annular conduit when the core is in its retracted position, the blades being arranged and oriented to impart a non-repetitive flow pattern to gases flowing through the conduit and past the blades, whereby turbulence is generated along a boundary between gases issuing from the discharge opening of the conduit and gases recirculating downstream of the cone end face and in a wake of the end face.

34. A burner assembly comprising an annular conduit disposed about a longitudinal axis of the burner and defined by an inner core and an outer, tubular wall, the conduit terminating at a discharge end thereof which, upon installation in a furnace, communicates with a combustion chamber of the furnace; means for flowing a mixture of combustion air and flue gas through the conduit; a fuel injector for injecting fuel into the mixture upstream of the discharge end of the annular conduit; the core including a downstream end section which terminates at the discharge end of the annular conduit; and a multiplicity of blades disposed in the annular conduit downstream of the fuel injector proximate the discharge end of the conduit, the blades extending over substantially an entire cross-section of the conduit, the blades being arranged, sized and oriented to impart a relatively turbulent, irregular flow pattern to the mixture and the fuel flowing through the conduit and past the blades so that turbulence is generated along a boundary between the mixture issuing from the discharge end of the conduit and combustion gases recirculating downstream of the end section when the burner is installed in a furnace and combustion takes place in the combustion chamber thereof.

35. A burner assembly according to claim 34 including a mechanism for moving the blades in a downstream direction away from the discharge end of the annular conduit so that the burner can optionally be operated by positioning the blades proximate the discharge end and remote from the discharge end.

36. A burner assembly according to claim 35 wherein the blades are attached to the core.

37. A method for operating a burner and generating relatively low $NO_x$ emissions comprising the steps of generating an annular flow of a combustion air-flue gas mixture concentrically about a longitudinal axis of the burner towards a combustion chamber; generating a multiplicity of fuel gas streams in the annular combustion air-flue gas flow; injecting the fuel gas streams at relative angles to the combustion air-flue gas flow which are selected so that fuel gas substantially uniformly mixes with the combustion air-flue gas flow and forms a uniform fuel gas-combustion air-flue gas mixture over an entire cross-section of the annular mixture flow upstream of the combustion chamber; and discharging the mixture flow and igniting the mixture flow in the combustion chamber; whereby the presence of the flue gas keeps combustion temperature relatively low and $NO_x$ generation is limited; wherein the step of injecting includes the step of imparting to the fuel gas streams a direction which includes relative to the axis an axial downstream directional component and a directional component relative to the axis, and a generally radially outward directional component for selected ones of the fuel gas streams and a radially inwardly directional component for selected other ones of the fuel gas streams.

38. A method according to claim 37 wherein the selected ones and the selected other ones of the fuel gas stream are injected into the gas flow from points spaced radially inwardly and radially outwardly, respectively, from radially outward and radially inward boundaries of the gas flow.

39. A burner assembly producing low $NO_x$ emissions having a longitudinal axis and comprising means forming an annulus about the axis and defining a downstream-facing, annular discharge opening; means for flowing combustion air in a downstream direction through the annulus; a tubular fuel gas header disposed in the annulus, located upstream of the discharge opening and including a multiplicity of orifices for a directionalized discharge of fuel gas streams through the orifices into the annulus, the orifices imparting a flow direction to the gas streams which includes a radial component, an axial component, and a tangential component relative to a circle concentric with the axis; a first subset of the orifices forming fuel gas streams having a radially inward flow direction and a second subset of the orifices having a radially outward flow direction; and energizing means imparting sufficient kinetic energy to the fuel gas streams so that they penetrate combustion air flowing through the annulus and mix with the air into a substantially uniform fuel gas-air mixture for discharge of the mixture from the downstream opening of the annulus.

40. A burner assembly producing low $NO_x$ emissions having a longitudinal axis and comprising means forming an annulus about the axis and defining a downstream-facing, annular discharge opening; means for flowing combustion air in a downstream direction through the annulus; first and second ring-shaped, tubular fuel gas headers each having a wall and disposed in the annulus, located upstream of the discharge opening and including a multiplicity of first and second orifices, respectively, defined by holes in the walls for a directionalized discharge of fuel gas streams through the orifices into the annulus, the orifices imparting a flow direction to the gas streams which includes a radial component, an axial component, and a tangential component relative to a circle concentric with the axis; a plurality of spaced-apart fuel gas supply pipes for and in fluid communication with each of the tubes for effecting a substantially even fuel gas pressure inside the tubes and over substantially their entire lengths; and energizing means imparting sufficient kinetic energy to the fuel gas streams so that they penetrate combustion air flowing through the annulus and mix with the air into a substantially uniform fuel gas-air mixture for discharge of the mixture from the downstream opening of the annulus.

41. A burner assembly producing low $NO_x$ emissions having a longitudinal axis and comprising means forming an annulus about the axis and defining a downstream-facing, annular discharge opening; means for flowing combustion air in a downstream direction through the annulus; first and second ring-shaped, tubular fuel gas headers disposed in the annulus and located upstream of the discharge opening, the first and second headers being concentric and radially spaced with respect to the burner axis and lying in a common plane which is substantially perpendicular to the axis; the first and second headers forming a multiplicity of orifices for a directionalized discharge of fuel gas streams through the orifices into the annulus, the orifices imparting a flow direction to the gas streams which includes a radial component, an axial component, and a tangential component relative to a circle concentric with the axis; and energizing means imparting sufficient kinetic energy to the fuel gas streams so that they penetrate combustion air flowing through the annulus and mix with the air into a substantially uniform fuel gas-air mixture for discharge of the mixture from the downstream opening of the annulus.

42. A burner assembly according to claim 41 including vanes disposed in the annulus upstream of the headers for forming a substantially axially oriented, low-turbulence combustion air flow in the annulus.

43. A burner assembly according to claim 42 including means for adding flue gas to the air flow at a point upstream of the headers.

44. A burner assembly producing low $NO_x$ emissions having a longitudinal axis and comprising means forming an annulus about the axis and defining a downstream-facing, annular discharge opening; means for flowing combustion air in a downstream direction through the annulus; a tubular fuel gas header disposed in the annulus, located upstream of the discharge opening and including a multiplicity of orifices for a directionalized discharge of fuel gas streams through the orifices into the annulus, the orifices imparting a flow direction to the gas streams which includes a radial component, an axial component, and a tangential component relative to a circle concentric with the axis; energizing means imparting sufficient kinetic energy to the fuel gas streams so that they penetrate combustion air flowing through the annulus and mix with the air into a substantially uniform fuel gas-air mixture for discharge of the mixture from the downstream opening of the annulus; a core section which is surrounded by the annulus and extends in a downstream direction of the burner to a plane which is proximate to a plane in which the discharge opening of the annulus is located; and flow deflectors located proximate the discharge opening of the annulus and operative to impart a non-repetitive, turbulent flow pattern to gas flowing past it.

45. A burner assembly according to claim 44 including an arrangement operatively coupled with the flow deflectors for flowing substantially the entire gas flow through the annulus past the flow deflectors when the core section is in its fully retracted position.

46. A burner assembly producing low $NO_x$ emissions having a longitudinal axis and comprising means forming an annulus about the axis and defining a downstream-facing, annular discharge opening; means for flowing combustion air in a downstream direction through the annulus; a tubular fuel gas header disposed in the annulus, located upstream of the discharge opening and including a multiplicity of orifices for a directionalized discharge of fuel gas streams through the orifices into the annulus, the orifices imparting a flow direction to the gas streams which includes a radial component, an axial component, and a tangential component relative to a circle concentric with the axis; energizing means imparting sufficient kinetic energy to the fuel gas streams so that they penetrate combustion air flowing through the annulus and mix with the air into a substantially uniform fuel gas-air mixture for discharge of the mixture from the downstream opening of the annulus; a core section which is surrounded by the annulus and extends in a downstream direction of the burner to a plane which is proximate to a plane in which the discharge opening of the annulus is located; and a plurality of auxiliary fuel gas discharge openings substantially equally distributed about the axis of the burner and located in a vicinity of the core section for discharging secondary fuel streams from the core section of the burner.

47. A burner assembly according to claim 46 wherein the auxiliary fuel discharge openings form secondary fuel gas streams which are oriented substantially tangentially relative to a circle concentric with the burner axis.

48. A burner assembly according to claim 46 including a liquid fuel discharge nozzle formed in the core.

49. A burner assembly according to claim 48 wherein the liquid fuel discharge nozzle is concentric with the burner axis.

50. A burner assembly comprising an annular conduit disposed about a longitudinal axis of the burner and defined by a core and an outer, tubular wall, the annular conduit including an upstream end, a fuel injection zone downstream thereof, and a fuel mixing zone downstream of the fuel injection zone and terminating in a discharge end of the conduit; the core including an end cone having a downstream oriented end face and a periphery which defines a radially inner, downstream end portion of the annular conduit; a fuel discharge header disposed in the fuel discharge zone and including a plurality of orifices for directing the fuel gas into the annular conduit and towards the mixing zone; means for connecting the headers with a source of fuel gas; a mechanism for axially moving the core relative to the fuel discharge header between extended and retracted positions in which the end face of the cone is relatively remote from and proximate to the fuel discharge header, respectively, whereby unstable combustion and flame pulsation are reduced when the core is in its retracted position and the burner is operated in its turn-down mode; and a multiplicity of blades carried by the core and arranged so that the blades extend over substantially an entire cross-section of the annular conduit when the core is in its retracted position, the blades being arranged and oriented to impart a non-repetitive flow pattern to gases flowing through the conduit and past the blades, whereby turbulence is generated along a boundary between gases issuing from the discharge opening of the conduit and gases recirculating downstream of the cone end face and in a wake of the end face.

* * * * *